US006629421B1

(12) United States Patent
Levitin et al.

(10) Patent No.: US 6,629,421 B1
(45) Date of Patent: Oct. 7, 2003

(54) METHOD OF AND AN APPARATUS FOR A SELF-GOVERNING PULSE FEEDING REFRIGERANT

(76) Inventors: Mikhail Levitin, P.O. Box 102, Reeders, PA (US) 18352; Boris Khaytin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 10/144,526

(22) Filed: May 14, 2002

(51) Int. Cl.[7] ..... F25B 45/00
(52) U.S. Cl. ..... 62/149; 62/115
(58) Field of Search ..... 62/115, 149, 277, 62/292, 151

(56) References Cited

U.S. PATENT DOCUMENTS 4,274,376 A * 6/1981 Tsiang et al. ..... 123/360
4,631,926 A * 12/1986 Goldshtein et al. ..... 62/115

* cited by examiner

*Primary Examiner*—Melvin Jones

(57) ABSTRACT

The present invention relates to a self-governing device for a pulse feeding method of a refrigerant in refrigeration systems. Due to the difference in the refrigerant's pressure and the temperature of the refrigerant vapor in the suction line the piston is moving as a shuttle to provide a self-dosing, pulse feeding supply of the refrigerant. The self-governing device with the pulse feeding method enables the system to regulate a gas defrost process of the evaporator and increases the efficiency of the heat exchange process.

5 Claims, 5 Drawing Sheets

METHOD OF AND AN APPARATUS FOR A SELF-GOVERNING PULSE FEEDING REFRIGERANT

BACKGROUND OF THE INVENTION

Refrigeration units used in refrigeration engineering contain a compressor that compresses the refrigerant vapor. The vapor is then cooled and condensed as a result of contact with a "cold source". With the use of the expansion valve the pressure of the condensed fluid is then decreased down to a pressure low enough to enable the vaporization of the fluid, which absorbs heat from the cooling matter by contacting a so-called, "hot source". Thereafter, the vaporized gas is returned to the compressor. This type of unit should be controlled to avoid interruption of service. Firstly, if the amount of heat available at the cold source is low, large quantities of liquid refrigerant may be returned to the compressor resulting in damage to the compressor and energy loss. Secondly, if the amount of heat that is available at the hot source is excessive, the rate of liquid flow arriving at the evaporator may not be high enough to maintain the hot source at a desired low temperature level. The excessive amount of heat from the hot source can damage the motor of the compressor.

In the U.S. Pat. No. 4,631,926 by Goldstein et all disclosed the refrigerating unit where the refrigerant flow was controlled by a solenoid valve that was placed between a condenser and an evaporator. The solenoid valve was operating in an "on-off" regimen and was providing liquid refrigerant in a pulse feed manner from the condenser to the evaporator. The liquid refrigerant was boiled out in the evaporator at a low pressure and temperature in a step-wise range with a number of steps, changing that pressure and temperature depending on the final temperature of the refrigerant, which was an average value from several differential pressure and temperature relays. The unit was able to operate with a minimum condensing pressure. The main disadvantage of the disclosed system was that the solenoid valve operates in a heavy-duty regimen due to the large number of circuit switches. Furthermore, the feed device for controlling the refrigerant flow was not reliable due to the use of pressure relay to govern the solenoid valve. In addition, the system for controlling the refrigerant flow was too complicated due to many pressure and temperature relays. Moreover, there was a problem connected with repulsion of the evaporator due to the low pressure of the steam refrigerant caused by a low ambient temperature of the air or water, which was cooling down the condenser.

In conclusion, a need existed for improving the construction and reliability of a refrigeration feed device.

SUMMARY OF THE INVENTION

According to the present invention the self-governing device for a pulse feeding process consists of a housing with an inlet and outlet, a cover, a bushing with two slots on its external surface and with two openings on each slot, positioned in the housing, a piston moving in the bushing and having separate left and right chambers with two openings each, respectively. When the movable piston is placed in the left position, the opening in the left chamber coincides with the corresponding opening in the bushing, and through the corresponding slot connects to the inlet through which the refrigerant flows from a condenser with a higher pressure. At the same time, the opening in the right chamber coincides with the corresponding opening in the bushing and through the corresponding slot connects to the outlet through which the refrigerant flows to an evaporator with lower internal pressure. Due to the difference in the refrigerant's pressure the piston moves to the right. When the movable piston reaches the right position, the opening in the left chamber coincides with the corresponding opening in the bushing and through the corresponding slot connects to the outlet through which the refrigerant flows to an evaporator with a lower internal pressure. At the same time, the opening in the right chamber coincides with the corresponding opening in the bushing and trough the corresponding slot connects to the inlet through which the refrigerant flows from the condenser with a higher pressure, and so on.

A refrigeration unit with a self-governing device for a pulse feeding process is comprised of a compressor, a condenser, an evaporator, the self-governing device for a pulse feeding process that is connected to the condenser and to said evaporator, respectively, a thermostat to control the temperature of the refrigerant vapor in a suction line, which is electrically connected to the compressor. When the temperature of the refrigerant vapor in the suction line decreases, in time, the thermostat turns the compressor's motor off and stops the cooling process. When the temperature of the refrigerant vapor in the suction line is increased, the thermostat turns the compressor's motor on and the cooling process will continue.

A refrigeration unit with the self-governing device for a pulse feeding process enables it to change the amount of refrigerant during the cooling process. It is comprised of a compressor, a condenser connected to at least two solenoid valves, a self-governing device for the pulse feeding process that is connected to solenoid valves and an evaporator, at least two thermostats that control the temperature of the refrigerant vapor in the suction line, and at least one of the thermostats is electrically connected to the corresponding solenoid valve and another thermostat is electrically connected to the compressor. When the temperature of the refrigerant vapor in said suction line decreases, in time the thermostat turns the corresponding solenoid valve off to reduce the refrigerant flow to the evaporator. If the temperature of the refrigerant vapor continues to fall and reaches the value established in a set point adjustment, the corresponding thermostat turns the motor of the compressor off and stops the cooling process. When the temperature of the refrigerant vapor in said suction line is increased, the thermostat turns the compressor's motor on and the cooling process will continue.

A refrigeration unit with the self-governing device for a pulse feeding process has a gas defrost and is comprised of a compressor, a condenser, a self-governing device for the pulse feeding process that is connected to the solenoid valve that is placed between the compressor and the condenser, an evaporator, a thermostat that is electrically connected to the compressor to control the temperature of the refrigerant vapor in the suction line, a solenoid valve that is placed on the line that connects the discharge line of the compressor with the evaporator and is electrically connected to the timer, a pressure controller with set point adjustment that is connected to the discharge line of the compressor, and is electrically connected to the solenoid valve that is placed on said line. When the temperature of the refrigerant vapor in the suction line decreases, in time the thermostat turns the compressor's motor off and stops the cooling process. When the temperature of refrigerant vapor in the suction line is increased, the thermostat turns the compressor's motor on and the cooling process will continue. The timer regulates the gas defrost process of the evaporator. This process starts at the time that is set on the timer, the solenoid valve that is placed between the condenser and the evaporator is closed and the circuit of the solenoid valve that is placed on the line and is connected to the discharge line of the compressor with the evaporator is locked; but the solenoid valve is opened if the pressure of refrigerant vapor in the discharge line is equal to or greater than the pressure that is set on the controller. The gas defrost process stops when a set-point time on the timer has elapsed. The solenoid valve that is placed between the compressor and the condenser is open, the circuit of the solenoid valve that is placed on the line connecting the discharge line of the compressor with the evaporator is open and this solenoid valve is closed.

The above described and many other features and attendant advantages of the present invention will become better understood by referring to the following detailed description when considered in conjunction with the accompanying drawings.

DESCRIPTION OF THE DRAWINGS

Detailed description of the preferred embodiment of the invention will be made with reference to the accompanying drawings.

DETAILED DESCRIPTION OF THE DRAWINGS

The following is a detailed description of the best presently known mode of carrying out the invention. This description is not to be taken in a limiting sense but is made merely for the purpose of illustrating the general principles of the invention. The scope of the invention is defined by the appended claims.

Figure 1:
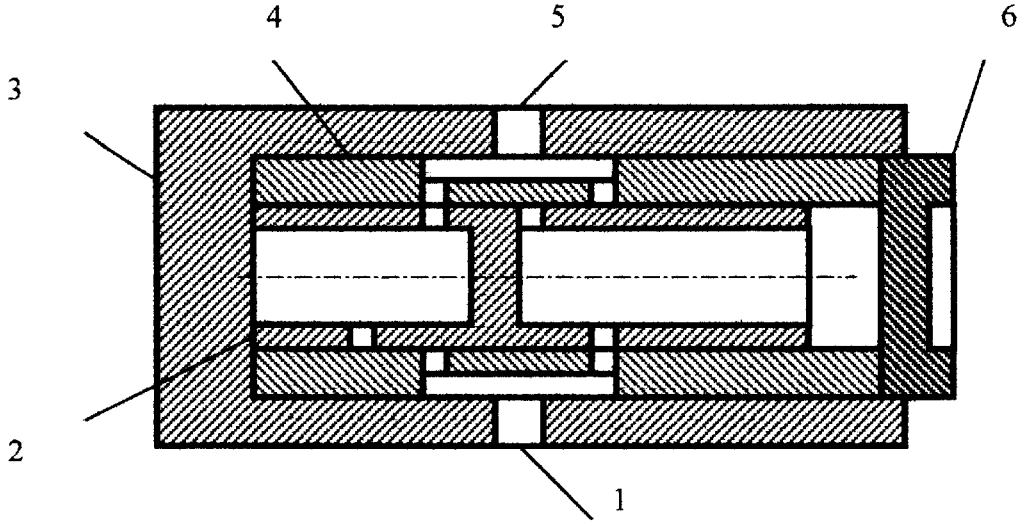
FIG. 1 shows a cross-section of self-governing device for a pulse feeding process with the piston in the left position.
Figure 2:
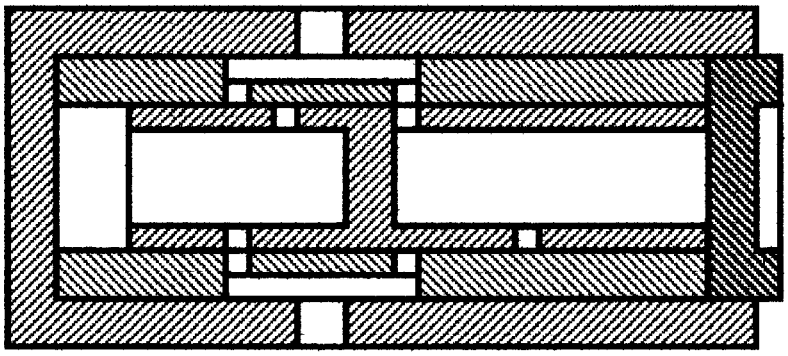
FIG. 2 shows a cross-section of self-governing device for a pulse feeding process with the piston in the right position.
Figure 3:
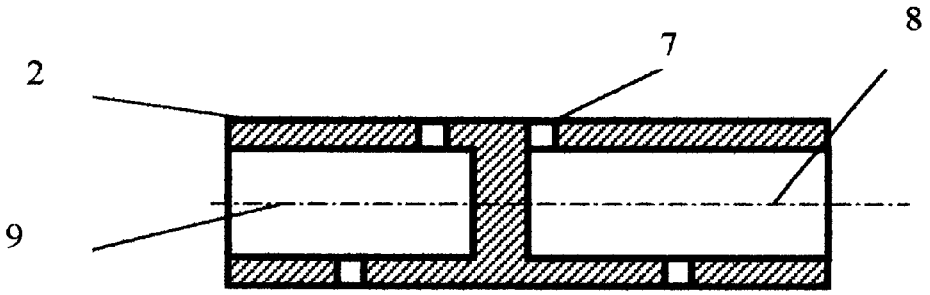
FIG. 3 shows a cross-section of the piston.
Figure 4:
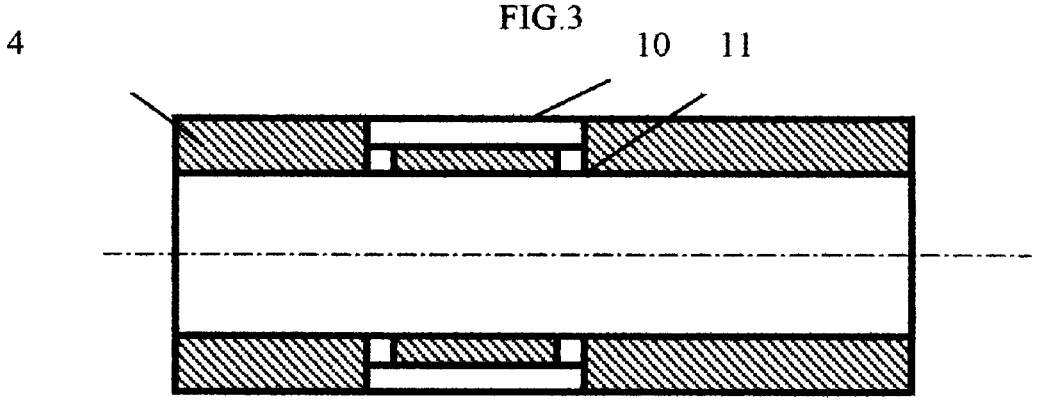
FIG. 4 shows a cross-section of the bushing.
Figure 5:
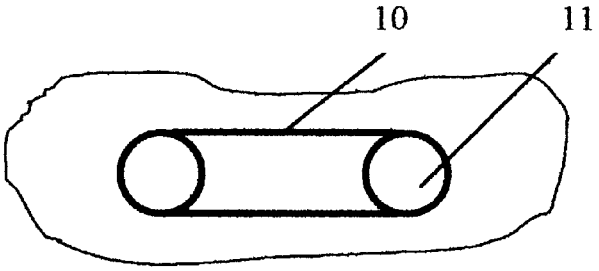
FIG. 5 shows a plan view of the slot on the external surface of the bushing.

The self-governing device for pulse feeding process (see FIG. 1) is comprised of a housing 3 with an inlet 5 and an outlet 1, a cover 6, a bushing 4 with two slots 8 on its external surface, each slot having two openings 10, (see FIG. 4 and FIG. 5), which are placed on the housing 3, and a piston 2 moving in the bushing 4 and having separate left, 9, and right, 10, chambers (see FIG. 3) with two openings 7 each, respectively.

When movable piston 2 is placed to the left, the opening 7 is placed in left chamber 9 and coincides with the corresponding opening 10 in the bushing 4 and through the corresponding slot 9 is connected to the inlet 5 through which the refrigerant flows from the condenser with higher pressure. At the same time, the opening 7 is placed in the right chamber 8 and coincides with the corresponding opening 10 in the bushing 4 and through the corresponding slot 9 is connected to the outlet 1 through which the refrigerant flows to an evaporator with lower internal pressure. Due to the difference in the refrigerant's pressure the piston moves to the right. When the movable piston 2 is placed to the right, the opening 7 is placed in the left chamber 8 and coincides with the corresponding opening 10 in the bushing 4 land through the corresponding slot 9 is connected to the outlet 1 through which the refrigerant flows to an evaporator with lower internal pressure. At the same time, the opening 7 is placed in the right chamber 8 and coincides with the corresponding opening 10 in the bushing 4 and through the corresponding slot 9 is connected to the inlet 5 through which the refrigerant flows from the condenser with higher pressure, and so on.

Figure 6:
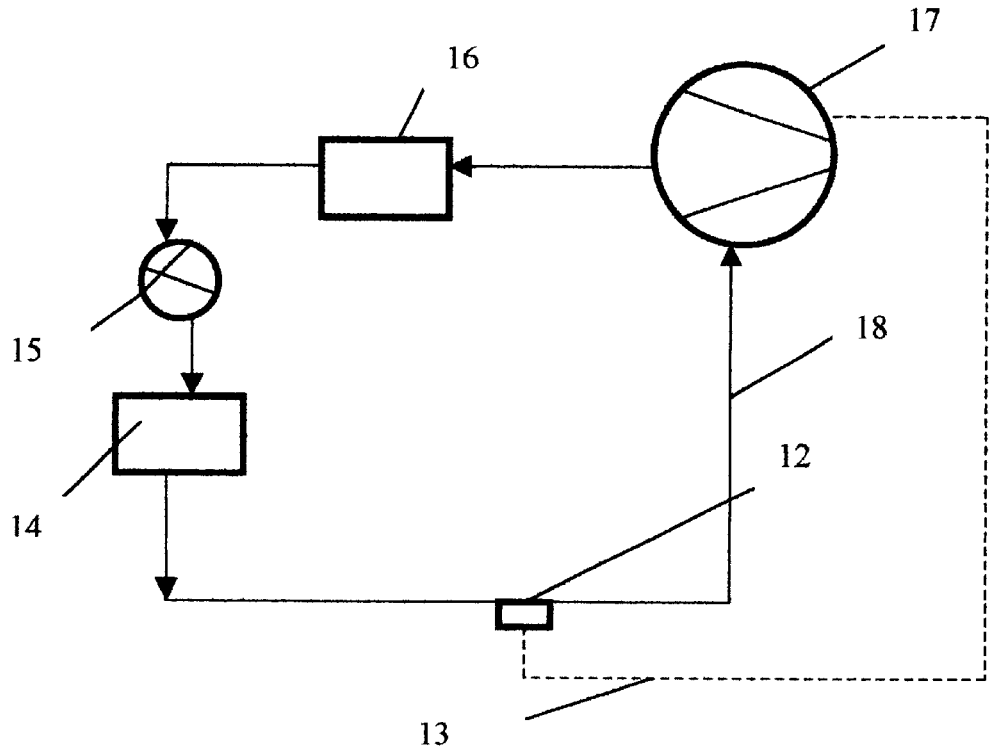
FIG. 6 shows a diagram of the refrigeration unit with the self-governing device for the pulse feeding process.

Referring to FIG. 6, the refrigeration, unit with the pulse feeding process is comprised of a compressor 17, a condenser 16, an evaporator 14, a self-governing device 15 for the pulse feeding process and which is connected to said condenser 16 and said evaporator 14, respectively, a suction line 18 that connects the evaporator 14 to the compressor 17, and a thermostat 12 that controls the temperature of the refrigerant vapor in the suction line 18 and is electrically connected by line 13 to the compressor 17. When the temperature of the refrigerant vapor in said suction line 18 decreases, in time, the thermostat 12 turns the motor of the compressor 17 off and stops the cooling process. When the temperature of the refrigerant vapor in the suction line 18 increases, the thermostat 12 turns the motor of the compressor 17 on and the cooling process will continue.

Figure 7:
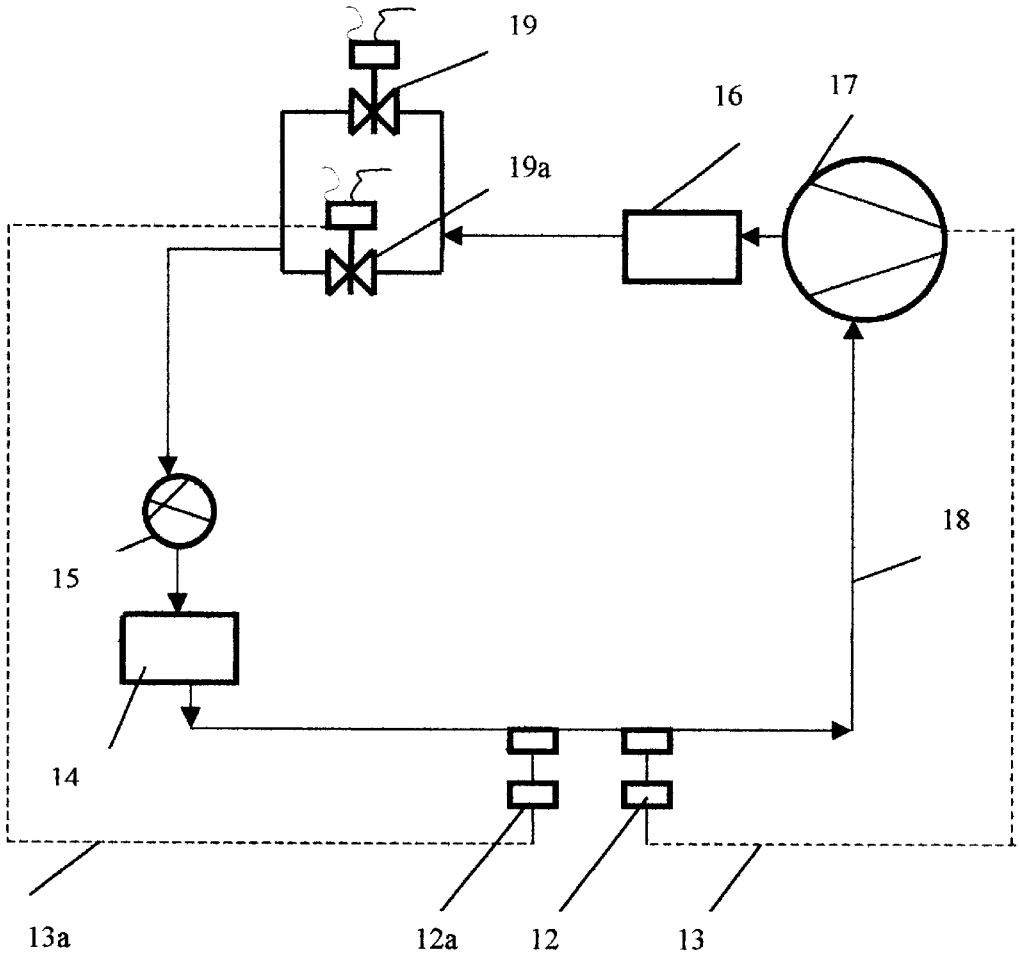
FIG. 7 shows a diagram of the refrigeration unit that enables it to change the amount of the refrigerant during the cooling process.

Referring to FIG. 7, the refrigeration unit with the self-governing device for the pulse feeding process which enables it to change the amount of the refrigerant during the process of cooling and is comprised of a compressor 17, a condenser 16 connected to at least two solenoid valves 19 and 19*a*, a self-governing device 15 for the pulse feeding process and which is connected to the solenoid valves 19 and 19*a*, an evaporator 14, a suction line 19 that connects the evaporator 14 to the compressor 17, and at least two thermostats 12 and 12*a* to control the temperature of the refrigerant vapor in the suction line 18 and of thermostats, 12, is electrically connected by line 13 to the compressor 17, and the other thermostat 12*a* is electrically connected to the corresponding solenoid valve 19*a* by the line 13*a*, respectively.

When the temperature of refrigerant vapor in suction line 18 decreases, in time, the thermostat 12*a* turns the corresponding solenoid valve 19*a* off to reduce the refrigerant flow to the evaporator 14. If the temperature of the refrigerant vapor continues to fall and reaches the value that is established at a set-point adjustment, corresponding thermostat 12 turns the motor of the compressor 17 off and stops the cooling process. When the temperature of the refrigerant vapor in said suction line 17 is increased, the thermostat turns the motor of the compressor 17 on and the cooling process will continue.

Figure 8:
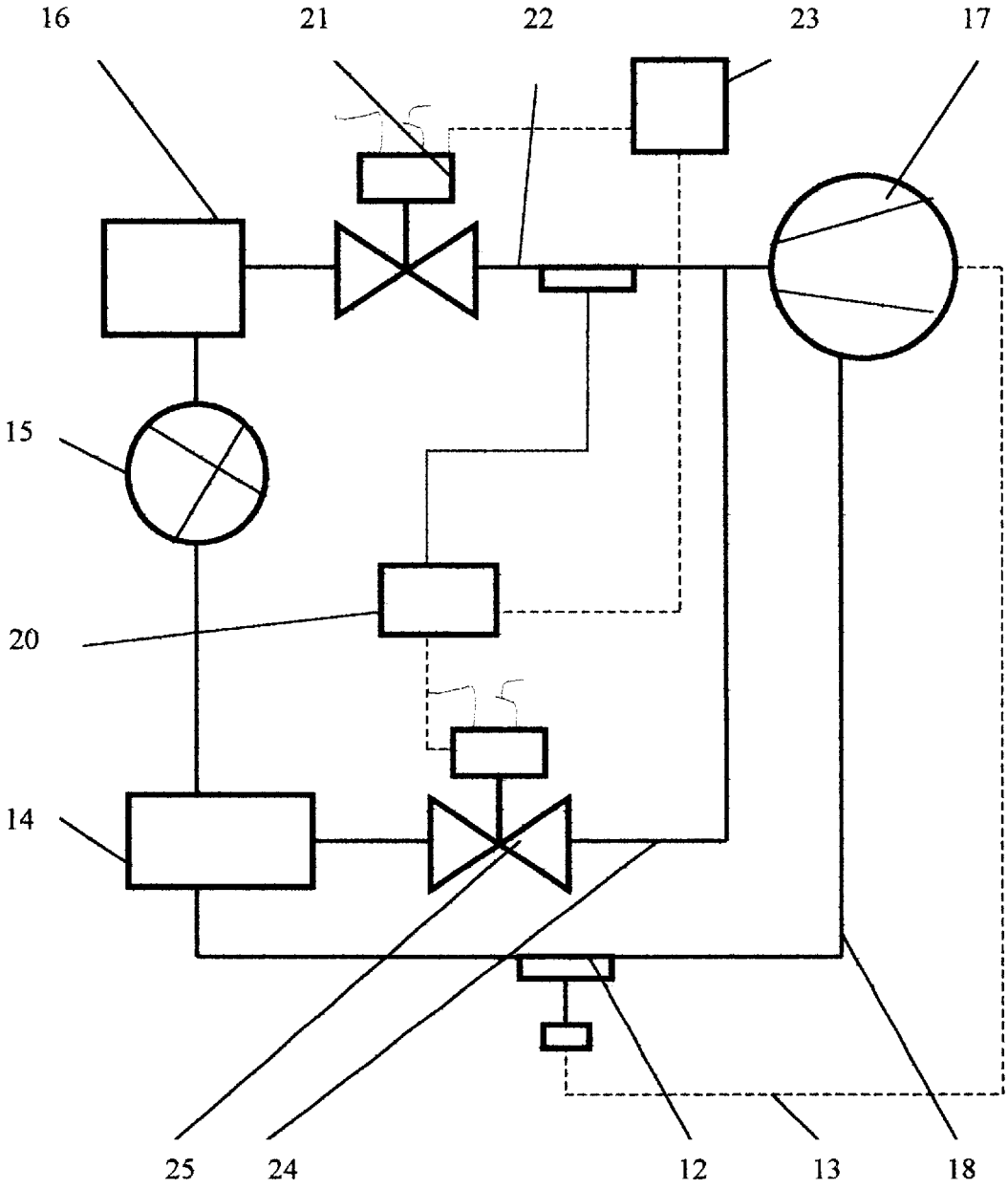
FIG. 8 shows a diagram of the refrigeration unit using a gas defrost system.

Referring to FIG. 8, the refrigeration unit with the self-governing device for the pulse feeding process having a gas defrost system and which is comprised of a compressor 17, a condenser 16, a self-governing device 15 for the pulse feeding process and which connects an evaporator 14 and said condenser 16 with a solenoid valve 21 that is placed between said compressor 17 and said condenser 16, a thermostat 12 to control the temperature of the refrigerant vapor in a suction line 18 and which is electrically connected to said compressor 17, a solenoid valve 25 that is placed on line 24 and connects discharge line 22 of said compressor 17 with said evaporator 14, and is electrically connected to a timer 23, a pressure controller 20 with a set point adjustment that is connected to said discharge Line 22 of said compressor 17 and is electrically connected to said solenoid valve 25 that is placed on said line 24, respectively. When the temperature of the refrigerant vapor in the suction line 18 decreases, in time, the thermostat 12 turns the motor of the compressor 17 off and stops the cooling process. When the temperature of the refrigerant vapor in said suction line 18 is increased, the thermostat 12 turns the motor of said compressor 17 on and the cooling process will continue. The timer 23 regulates the gas defrost process of the evaporator 14. This process starts at the time that is set on the timer 23. The solenoid valve 25 is placed between the condenser 16 and evaporator 14 and is closed. The circuit of the solenoid valve 21 is locked and placed on the line 24 that connects the discharge line 22 of the compressor 17 with the evaporator 14, but the solenoid valve 25 is opened if the pressure of the refrigerant vapor in the discharge line, 22 is equal to or greater than the pressure value that is set on the controller 20. The gas defrost process stops when the time that was set on the timer 22 elapses. The solenoid valve 21 is placed between said compressor 17 and the condenser 16 and is open, although the circuit of the solenoid valve 25 is closed.

We claim:

1. A refrigeration unit has a gas defrost system and is comprised of a compressor, a condenser, a self-governing device for the pulse feeding process and which is connected to a solenoid valve that is placed between said compressor and said condenser, an evaporator, a timer, a thermostat to control the temperature of the refrigerant vapor in a suction line connected electrically to said compressor, a solenoid valve placed on a line, which connects discharge line of said compressor with said evaporator, and is connected electrically to said timer, a pressure controller with set-point adjustment wherein said pressure controller is connected to said discharge line of said compressor and electrically connected to said solenoid valve that is placed on said line connecting said discharge line of said compressor to said evaporator, respectively.

2. A refrigeration unit with a self-governing device for a pulse feeding process, which allows for a change in the amount of the refrigerant during the cooling process and is comprised of a compressor, a condenser connected to at least two solenoid valves, a self-governing device for the pulse feeding process and which is connected to said solenoid valves and to an evaporator, respectively, a suction line connected to said evaporator and to said compressor, at least two thermostats to control the temperature of the refrigerant vapor in said suction line, with at least one thermostat electrically connected to said compressor, and another thermostat electrically connected to another solenoid valve.

3. A refrigeration unit with pulse feeding process and which is comprised of a compressor, a condenser, an evaporator, a self-governing device for the pulse feeding process and that is connected to said condenser and said evaporator, respectively, a suction line that connects said evaporator to said compressor, and a thermostat that is electrically connected to said compressor and that controls the temperature of the refrigerant vapor in said suction line.

4. A self-governing device for a pulse feeding process that is comprised of a housing having an inlet and an outlet, a cover, a movable piston that is placed in a bushing, which is set in said housing, with two slots on the external surface of said bushing and with two openings on each of said slots.

5. A self-governing device for the pulse feeding process according to claim 4, wherein said movable piston has two separate chambers, left and right, each having two openings.

* * * * *